US006192859B1

(12) United States Patent
LeFevre

(10) Patent No.: US 6,192,859 B1
(45) Date of Patent: Feb. 27, 2001

(54) LOW COST, TEMPERATURE STABLE, ANALOG CIRCUIT RPM LIMITER

(76) Inventor: Robert P. LeFevre, 15 Emery St., Methuen, MA (US) 01844

( * ) Notice: Subject to any disclaimer, the term of this patent is extended or adjusted under 35 U.S.C. 154(b) by 0 days.

(21) Appl. No.: 09/312,400

(22) Filed: May 14, 1999

(51) Int. Cl.[7] ..... F02P 9/00
(52) U.S. Cl. ..... 123/335; 123/406.66
(58) Field of Search ..... 123/335, 406.66

(56) References Cited

U.S. PATENT DOCUMENTS

| | | | | |
|---|---|---|---|---|
| 5,048,486 | * | 9/1991 | Okuda et al. | 123/406.66 |
| 5,245,965 | * | 9/1993 | Andersson | 123/335 |
| 5,383,433 | * | 1/1995 | Fiorenza, II | 123/335 |
| 5,755,199 | * | 5/1998 | Costello et al. | 123/335 |

* cited by examiner

*Primary Examiner*—John Kwon
(74) *Attorney, Agent, or Firm*—Perkins, Smith & Cohen,LL; Jerry Cohen

(57) ABSTRACT

Analog RPM limiting circuit for use with various types of ignition systems, employing a temperature stabilizing transistor Q3(6) configured as a single junction with biasing resistor R1*a*(7), a transistor Q2(5) used as a voltage threshold as well as a rapid timing capacitor recharging switch with a regenerative loop supplying bias to an associated regenerative capacitor charging switch Q1(4) constituting a mono-stable multivibrator, with a manual switch S1 for selecting timing capacitors for scaling the timing period according to the number of cylinders, and with another manual switch Q2 for selecting timing resistors for user adjustable RPM limit range, and Q1 and Q2 also used for imput triggering and output signal inhibition to provide the RPM limiting function.

An improved, simple, low cost, temperature stable full featured analog RPM limiting circuit for use with various types of ignitions, integrated within or external to ignition systems, employing a temperature stabilizing transistor Q3(6) configured as a single junction with biasing resistor R1*a*(7), a transistor Q2(5) used as a voltage threshold as well as a rapid timing capacitor recharging switch with a regenerative loop supplying bias to an associated regenerative capacitor charging switch Q1(4) constituting a mono-stable multivibrator, with a manual switch S1 for selecting timing capacitors for scaling the timing period according to the number of cylinders, and with another manual switch S2 for selecting timing resistors for user adjustable RPM limit range, and Q1 and Q2 also used for input triggering and output signal inhibition to provide the RPM limiting function.

28 Claims, 2 Drawing Sheets

QUIESCENT STATE

QUASI STABLE STATE

TEMPERATURE STABILIZED

LOW COST, TEMPERATURE STABLE, ANALOG CIRCUIT RPM LIMITER

FIELD OF THE INVENTION

This invention relates to ignition systems, capacitive discharge, inductive, or other, for internal combustion engines for limiting maximum engine RPM (REV) as is required in racing and performance applications or other applications where REV limiting is required. In particular, this invention uses a simple analog circuit approaching the accuracy and temperature stability of the more complex hard wired digital base or microprocessor REV limiters.

BACKGROUND OF THE INVENTION AND PRIOR ART

Current ignitions typically use the more complex digitally processed or microprocessor REV limiting systems with two separate sets of code switches to allow user selectable REV limit and the number of engine cylinders, such as 4, 6 or 8 cylinders. Prior to the newer microprocessor based limiter, the more complex and expensive hard wired digital limiters replaced analog circuitry due to their significantly improved temperature stability. In contrast, the more recent microprocessor REV limiter replaces much of the hard wired digital circuitry, but additionally requires software to function.

A microprocessor REV limiter requires circuitry such as input trigger, output stages, and a stable clock oscillator for the processor chip to function and interface with the outside world. This forms the processor's basic hardware circuit which is internally controlled by software, i.e. a written set of programmed instructions that directs the entire operation of the processor. The software program is a set of detailed operating instruction on how the processor will function for sensing input ignition trigger signals, comparing that input trigger frequency to the REV limit selected by the user switches, accounting for the number of cylinders as selected by the cylinder switches, and how the output will occur when REV limit has been reached. Once the program has been written, debugged and proven reliable, it must then be download into each microprocessor integrated circuit (IC) chip for it to function as a REV limiter. This new approach accurately compares the elapsed time between ignition trigger pulses to that of a high frequency temperature stable crystal oscillator, also known as the microprocessor clock which steps the processor through each programmed instruction. The crystal oscillator frequency, typically in the mid megaHertz (mHz) range, is scaled down by division to an appropriate frequency as dictated by the particular application. Unfortunately, this very accurate approach to controlling RPM is complex and costly for such a simple task. Other techniques using analog circuitry are simpler but suffer from temperature instability. As engine ignition control electronics is normally subjected to wide temperature variations when operating in the proximity of the enclosed area of a hot engine, the thermal instability of the analog circuit limits its use for such applications.

However, by careful design consideration of the specific elements of analog circuitry that produces the thermal instability, the negative temperature coefficient of a semiconductor junction can effectively be canceled to produce a low cost, simple, thermally stable circuit that is well suited for ignition RPM control (REV limiting). Like its expensive microprocessor counter part, the analog RC timing circuit approach can easily incorporate all of the features for external user selectable RPM and the selection of the number of cylinders.

It is therefore an object of the present invention to limit RPM through an analog system, or substantially analog system with minor digital adjuncts, overcoming the disadvantages of the state-of-the-art digital and microprocessor based systems outlined above.

SUMMARY OF THE INVENTION

The REV limiter circuit of the present invention is applicable to any type of ignition system or any application requiring thermally stable and accurate timing control functions. In addition, the REV limiter can be easily interfaced with an existing ignition controller either internally or externally as a stand-alone system. Through the use of a temperature compensated RC timing circuit operating as a mono-stable multivibrator, input or output trigger signals from an ignition system can be inhibited at any preset RPM.

The timing circuit incorporates a simple topology comprised of a charging switching element to define and control the charging of a timing capacitor through a timing resistor (with an RC time constant) and a second switching element with a transistor base-emitter junction with a negative temperature coefficient (−2.5 mv/degree C) used as a voltage threshold switch to turn off the charging switching element to end the capacitor charging as well as to rapidly recharge the capacitor to its initial value. The temperature sensitivity of the transistor voltage threshold switch junction can be overcome by placing an additional semiconductor junction in the capacitor's initial condition current recharging path. The additional semiconductor junction should be configured as a diode junction from the same type transistor as the voltage threshold transistor switch forming a simple monostable circuit that overcomes its inherent temperature instability. In this way, circuit sensitivity to temperature variations can be effectively canceled producing a temperature stable timing circuit that can function as reliably as the more complex and expensive digital and micro-processor version for performance application.

While this analog REV limiter will not achieve the extreme accuracy of the digital of microprocessor based limiter, it can achieve 1% accuracy through the use of higher accuracy, off-the-shelf 1% resistors and 2% or better capacitors, which is an accuracy suitable for most applications while maintaining a simple low cost and reliable solution.

Other objects, features, and advantages of the invention will be apparent from the following detailed description of a preferred embodiment thereof including the accompanying drawing in the figures, in which:

DESCRIPTION OF PREFERRED EMBODIMENTS

Figure 1:
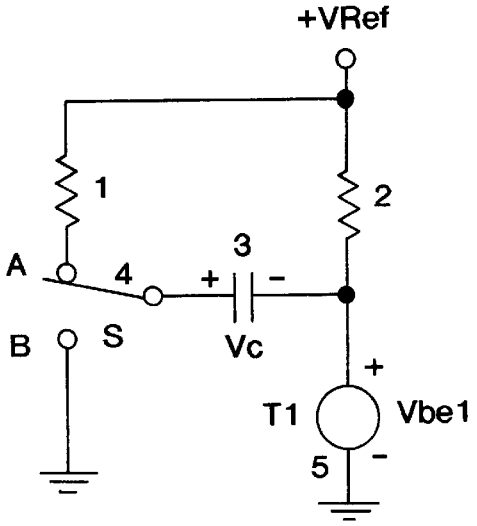
FIG. 1 is a simplified, partial circuit diagram of a standard RC timing network in a quiescent state without temperature compensation used for a REV limiter.
Figure 2:
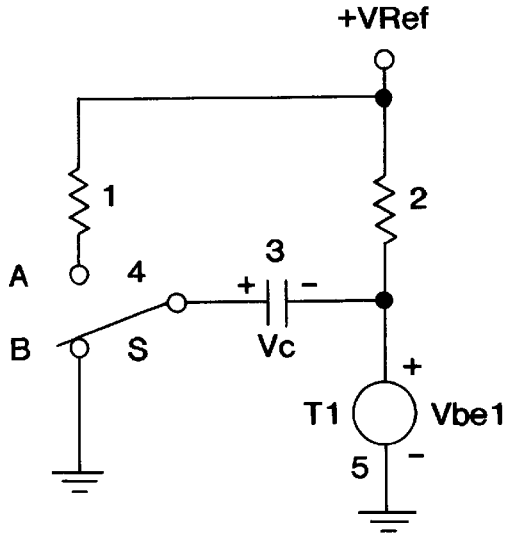
FIG. 2 is a simplified, partial circuit diagram of the standard RC timing network in the quasi-stable (active timing state) without temperature compensation used for a REV limiter.

FIGS. 1 and 2 are simplified circuit, partial diagrams for a typical RC timing network with inherent thermal instability resulting from (base-emitter junction) of T1(5) shown partially represented by Vbe1 with a negative temperature coefficient (typically −2.5 mV/degree C), with Vbe1 serving as a voltage threshold switch. This circuit has two operational states: 1) a quiescent stable state shown with switch S(4) in the upper position A (FIG. 1) which establishes the timing circuit's initial value conditions, and 2) a quasi-stable state when switch S is in position B (FIG. 2) representing the active timing state for this circuit. State 1, the quiescent condition can be further described by T1 having a voltage polarity of say +0.6V as shown with a stabilized charge voltage Vc having been reached on capacitor 3. In normal operation, the repetition rate of switch S is such that capacitor 3 will have sufficient time to completely charge in a time Tsh that is short relative to the charge time Tch associated with the quasi-stable state of FIG. 2, e.g. Tsh is typically less than 1/10th of Tch for the minimum value of Tch. State 2, the quasi stable active state exists for the period of time Tch that the voltage across T1 is less than +0.6 volts with the active state terminating when the voltage across Vbe1 is equal to or greater than +0.6 volts (the base-emitter voltage). The polarity reversal across T1 occurs when switch S is moved to position B with that instant of time (t0) initiating the active state. State 2 is the active timing for the RPM limit set period that is compared to the duration between input ignition trigger pulses.

Capacitor 3 initial voltage condition is represented by Vc (FIG. 1) and assumes the capacitor is fully charged. Writing the capacitor's initial voltage condition with switch S in position A and charging current i=0 is shown as:

$$Vc\ (\text{capacitor initial condition})=Vref-Vbe1$$

When switch S is moved to position B, representing an input trigger signal, the polarity across T1 reverses as shown in FIG. 2 with the relationship for the summation of the voltages at (t0), at the instant switch S is toggled.

$$0=-Vbe1+Vref-[Vref-Vc]$$

The only variable term above is Vbe1 which has the negative temperature coefficient of the transistor base-emitter junction. By adding another temperature dependent element such as Vbe in the circuit, it is possible to cancel this temperature variation.

Figure 3:
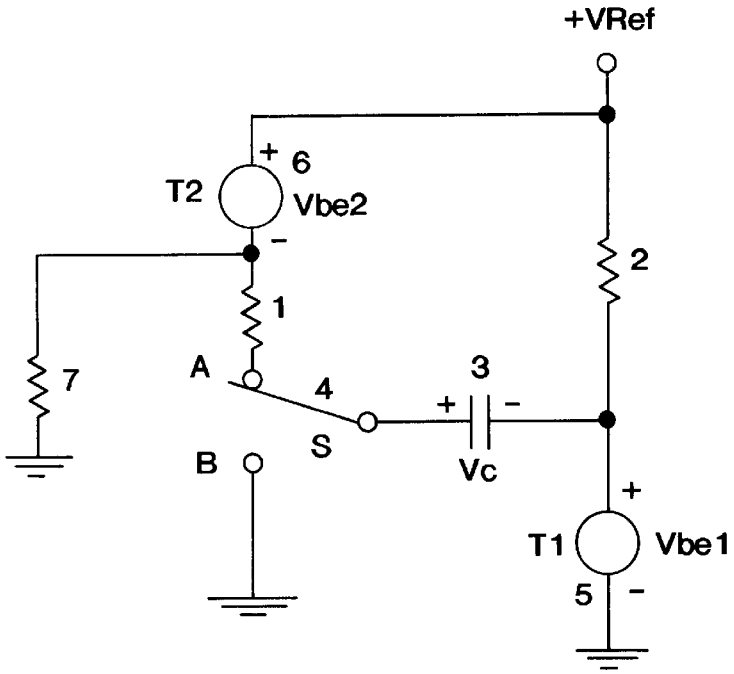
FIG. 3 is a partial circuit diagram of an improved circuit of FIGS. 1 and 2 in accordance with a preferred embodiment of the present invention with the addition of a semiconductor to cancel out the inherent transistor junction negative temperature coefficient to comprise an embodiment for an improved analog RC timing circuit.

FIG. 3 shows a circuit according to a preferred embodiment of the present invention, one which adds a semiconductor junction to state-of-the-art FIGS. 1 and 2 circuits. The junction is represented by T2(6), or Vbe2, and its associated biasing resistor 7 which sets the operating bias on T2 at approximately the same operating point as T1, biased by resistor 2, for best thermal tracking. Capacitor 3 now has a new initial voltage value that results in the relationship when switch S is again moved to position B at (t0).

$$0=-Vbe1+Vref-[Vref-Vc-Vbe2]$$

The two temperature dependent variables cancel restricting the timing accuracy to the that of the RC components only, producing a simple temperature stable timing circuit.

Figure 4:
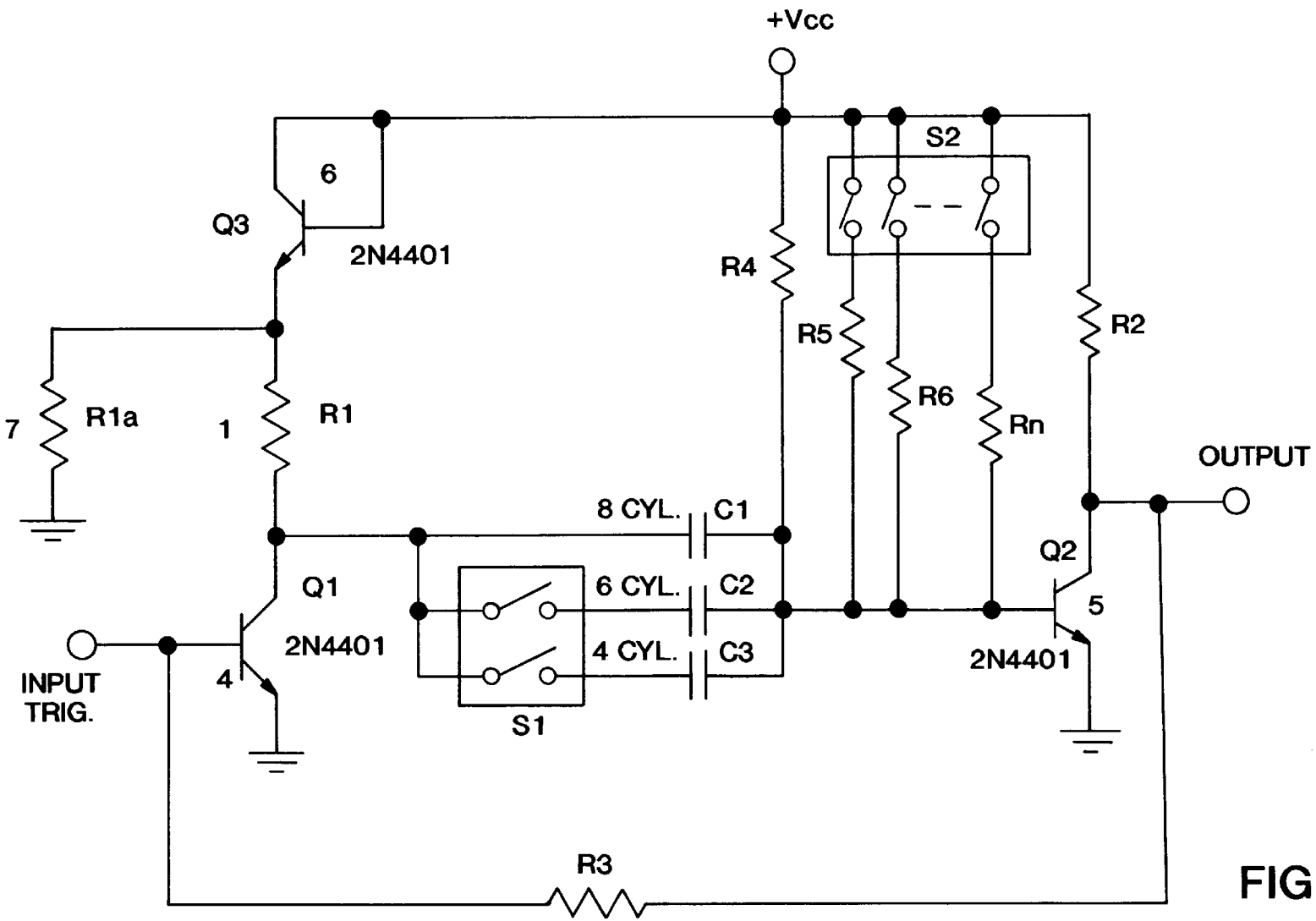
FIG. 4 is a more detailed, largely circuit drawing of a preferred embodiment of the topology shown in FIG. 3 showing practical RPM limiter circuit with temperature stabilized RC timing circuit for and engine ignition system.

FIG. 4 shows a practical implementation of this simple temperature stable topology of FIG. 3 for an ignition RPM limiter with a cylinder select switch S1 and a switch S2 to select RPM limit values. Like numerals represent like parts with respect to the earlier figures. Transistor Q2(5) can be an NPN which serves as a voltage threshold switch with its output controlling charging NPN transistor Q1(4). The base of transistor Q1 is a means of receiving conditioned positive ignition trigger pulses. Negative input trigger pulses can also be utilized by pulling the base of transistor Q2 negative through an isolation/steering diode or some similar circuit arrangement. For best thermal compensation and tracking, Q3(6) should be of the same polarity, type and number as Q2, but configured as a single junction and located in close proximity to Q2, to minimize the temperature gradient between Q2 and Q3, with resistor R1*a*(7) biasing Q3 at approximately the same junction operating point as Q2. Transistor Q3 could, in principle, be replaced by a diode with a similar junction material as Q2. Transistor Q3 is located between +Vcc and Resistor 1(R1) such that biasing current through Q3 supplied by resistor R1*a* will not be drawn through resistor R1. Resistor R1 is the collector load of NPN transistor Q1 and the current charging path for the timing capacitors. Resistor R2 is a collector load for Q2 and supplies regenerative bias to the base of Q1 through resistor R3. Timing capacitor C1 through C3 provide a means of scaling the RC time constant for selecting the number of engine cylinders with user selectable switches (DIP switches used in this circuit). Resistors R4 through Rn are the timing resistors used to select the RPM limit with an appropriate number of (DIP) switches. This switching arrangement is configured to enable the use of one switch at a time, but could be configured to also operate switches in parallel with the appropriate timing component value changes. Timing RC component C1 and R4 serve as default components useful also in the event of a defective switch, in which case the circuit would limit at the lowest design RPM (for an 8-cylinder engine indicated) to prevent the possibility of engine run away or destruction.

It can be seen through the prior disclosure that a particular simple form of REV limiter has been achieved which can provide 1% to 2% REV limiting accuracy through the use of low cost and readily available 1% resistors and 1% to 2% capacitors, and which is able to maintain such accuracy over a wide temperature range as is found in conventional and performance automobiles, and other applications. The inherent simplicity of the system translates into lower cost of parts and lower cost of manufacture, as well as less chance of system failure given there are only two active components in the basic system, in the form of two transistors in the preferred embodiment disclosed.

Other variations of this basic circuit of FIG. 4 are possible, such as the use of PNP transistors in place of NPN transistors, and other variations. It will be understood that the reference made, for convenience, in the claims to circuit elements such as Q1, R1, Rt, Ct is not limited to the components so identified in FIGS. 1 to 4, but is broader. Many changes to the above design may be made without departing from the scope of this disclosed invention. All matter contained in the above description, or shown in the accompanying drawing, shall be interpreted in an illustrative and not limiting sense.

What is claimed is:

1. An RPM limiter, REV limiter, for engine ignition systems with a cycling charge/discharge for firing one or more igniters comprising means defining an RPM limiter circuit including:

a) at least one timing resistor means Rt, timing capacitor means Ct, and a regenerative switch means Q1 located in a series current charging path for charging capacitor means Ct in a time period Tch proportional to the product Ct•Rt, b) one voltage threshold switch Q2 also used to set the circuit's initial condition by rapidly recharging the timing capacitor means Ct in a time Tsh which is much shorter than a charge time Tch to provide, with Q1, the action of a mono-stable multivibrator, c) a switch S1 to select various timing capacitors as a means of scaling the timing period Tch to correspond to various number of engine cylinders, d) a switch S2 to select various timing resistors for different charge times Tch and hence different RPM limits, e) and a temperature stabilizing transistor/diode element Q3 with resistor R1*a* which sets the operating point of the temperature stabilizing element to compensate for the temperature dependence of the voltage threshold of Q2, the circuit constructed and arranged such that when a trigger is received at either of Q1 or Q2, the circuit transitions into a timing state of charging the capacitor means Ct in a time governed by the time constant Ct•Rt to provide the required REV limiting of the igniter firing.

2. An RPM limiter circuit as defined in claim 1 wherein one timing capacitor and one timing resistor are configured as default components to provide the lowest design RPM limit for a given number of engine cylinders.

3. An RPM limiter circuit as defined in claim 1 wherein the voltage threshold switch Q2 and the regenerative switch Q1 are both NPN transistors.

4. An RPM limiter circuit as defined in claim 1 wherein the voltage threshold switch Q2 and the regenerative switch Q1 are both PNP transistors with the appropriate circuit reference topology for the reverse polarity semiconductor.

5. An RPM limiter circuit as defined in claim 1 wherein the regenerative charging transistor switch Q1 is a field effect transistor, FET.

6. An RPM Limiter circuit as defined in claim 1 wherein the charging transistor switch Q1 comprises inverting IC voltage comparator to perform a similar function as transistor switch Q1.

7. An RPM limiter circuit as defined in claim 1 wherein threshold switch Q2 is an FET.

8. An RPM limiter circuit as defined in claim 1 wherein switch S1 has multiple switching positions with capacitors associated with the positions including a single capacitor without switch S1 to provide an Rt•Ct combination with at least one associated resistor Rt.

9. An RPM limiter circuit as defined in claim 1 wherein switch S2 has multiple associated resistors including a single resistor without switch S2 to provide an Rt•Ct combination with at least one associated capacitor Ct.

10. An RPM limiter circuit as defined in claim 1 wherein input triggers are means for providing a form of positive or negative transitions at the base or collector of Q1 or Q2.

11. An RPM limiter circuit as defined in claim 1 wherein the temperature stabilizing element Q3 is of similar semiconductor construction and material as that of the voltage threshold switch transistor Q2 and is configured as a junction diode located in the capacitor's Ct initial condition current charging path.

12. An RPM limiter circuit as defined in claim 1 wherein the temperature stabilizing element Q3 is of similar semiconductor construction and material as that of the voltage threshold switch transistor Q2 and comprises a simple two lead diode element located in the capacitor's Ct initial condition current charging path.

13. An RPM limiter circuit as defined in claim 1 wherein the temperature stabilizing element Q3 is located between regenerative switch Q1's load resistor R1 and Vcc.

14. An RPM limiter circuit as defined in claim 1 wherein the temperature stabilizing transistor Q3 configured as a diode junction has a value of resistor R1*a* defined to set the operation point of the diode junction to match the operating point of the voltage threshold transistor junction.

15. An RPM limiter circuit as defined in claim 1 wherein the timing resistor Rt or an equivalent controlled current source also serves as the biasing element for the transistor Q2 base-emitter junction.

16. An RPM limiter circuit as defined in claim 15 wherein a variable current source is provided to a capacitor plate and may be externally controlled to change or alter the capacitor charge rate or RPM limit.

17. An RPM limiter, REV limiter, for engine ignition systems with a cycling charge/discharge for firing one or more igniters comprising means defining an RPM limiter circuit including:

a) at least one timing resistor means Rt, timing capacitor means Ct, and a regenerative switch means Q1 located in a series current charging path for charging capacitor means Ct in a time period Tch proportional to the product Ct•Rt, b) one voltage threshold switch Q2 also used to set the circuit's initial condition by rapidly recharging in Tsh the timing capacitor means Ct following charging of Ct through Q1, the rapid recharging time Tsh which is much shorter than a charge time Tch to provide, with Q1, the action of a mono-stable multivibrator, the circuit constructed and arranged such that when a trigger is received at either of Q1 or Q2, the circuit transitions into a timing state of charging the capacitor means Ct in a time governed by the time constant Ct•Rt to provide the required REV limiting.

18. An RPM limiter circuit as defined in claim 17 including a switch S1 to select various timing capacitors as a means of scaling the timing period Tch to correspond to various number of engine cylinders, and a switch S2 to select various timing resistors for different charge times Tch and hence different RPM limits.

19. An RPM limiter circuit as defined in claim 17 including a temperature stabilizing transistor-diode element Q3 to compensate for the temperature dependence of the voltage threshold of Q2.

20. An RPM limiter circuit as defined in claim 19 including a resistor R1*a* for use with the transistor-diode element Q3 to set its operating point.

21. A simple, low cost, temperature stable analog RPM limiting circuit operating as a mono-stable multivibrator for use with various types of ignition systems for engines, including a) means for selecting timing capacitor means Ct for scaling the timing period Tch according to the number of cylinders, b) means for selecting timing resistor Rt for user adjustable RPM limit, the circuit constructed and arranged to use Q2 as a voltage threshold switch for ending an RPM limit charge time Ct•Rt determined by charging of capacitor Ct to the voltage threshold of Q2 through resistor Rt and through regenerative switch means Q1, with switch Q2 further operating in a regenerative loop supplying bias to keep in a turned-on state the associated switch means Q1 during said charging of capacitor Ct through Rt as well as to provide very rapid recharging of capacitor Ct to an initial stable state ready for charging capacitor Ct through Q1, and to further use input triggering to initiate charging through Q1 and output signal inhibiting means for inhibiting input triggering during charging through Q1, to provide an accurate RPM limiter for use with engine ignition systems and other dynamic systems requiring RPM control.

22. The RPM limiter circuit as defined in claim 21 including a temperature stabilizing transistor Q3 configured as a single junction with biasing resistor R1*a* to cancel the temperature dependence of the voltage threshold of transistor Q2.

23. An ignition system for one or more igniters which are fired to create cyclic variable speed drive (RPM) connected back to the ignition system for switching on-off (toggling) the firing of each igniter, the ignition system being effective to limit RPM by disabling the firing of the igniters at a particular RPM for a given number of engine cylinders, the system comprising:

(a) first means comprising an RC charging circuit in an electrical charging path for effecting an electrically regenerative switching action in the charging path;

(b) second means for effecting a supplementary switching action to set the initial condition of the RC charging circuit as well as to set a voltage threshold condition for the RC circuit to terminate its charging; and (c) third means defining a timing period scaling of the circuit correlated to the number of engine cylinders and a particular RPM at which the one or more igniters will not fire in their normal firing sequence.

24. An RPM limiting system of claim 23 wherein there is included a fourth means for temperature compensating the voltage threshold of the second means.

25. An RPM limiting system of claim 24 wherein said voltage threshold and temperature compensating means comprise semiconductor materials configured together as junction diodes with the same junction voltage temperature dependence.

26. An RPM limiting system of claim 25 with a set operating point resistor for the temperature compensating semiconductor means.

27. An RPM limiting system of claim 25 with a constant current source controlling and stabilizing the diode junction operating set point of the temperature compensating semiconductor means.

28. An RPM limiting system of claim 23 configured for a single period or RPM limit with a constant current source biasing the regenerating switching action first means.

* * * * *